United States Patent [19]

Heitmann

[11] Patent Number: 4,646,986

[45] Date of Patent: Mar. 3, 1987

[54] APPARATUS FOR LOCATING, ENGAGING AND TRANSPORTING THE LEADER OF CONVOLUTED CIGARETTE PAPER OR THE LIKE

[75] Inventor: Bob Heitmann, Hamburg, Fed. Rep. of Germany

[73] Assignee: Hauni-Werke Körber & Co. KG, Hamburg, Fed. Rep. of Germany

[21] Appl. No.: 794,109

[22] Filed: Nov. 1, 1985

[30] Foreign Application Priority Data

Nov. 22, 1984 [DE] Fed. Rep. of Germany ..... 3442563

[51] Int. Cl.[4] ..... B65H 19/18

[52] U.S. Cl. ..... 242/58.1; 242/55; 226/92

[58] Field of Search ..... 242/56 R, 56 A, 58.1, 242/58.3, 58.4, 55, 195, 78.8; 226/92, 91, 173

[56] References Cited

U.S. PATENT DOCUMENTS 3,010,672 11/1961 Cecil, Jr. ..... 242/78.8
3,461,703 8/1969 Ranney ..... 242/78.8 X
3,550,880 12/1970 Palmer ..... 242/195 X
3,823,888 7/1974 Zangenfeind et al. ..... 242/55
4,131,501 12/1978 Bottcher et al. ..... 242/58.3 X
4,245,795 1/1981 Ludszeweit et al. ..... 242/56 R

FOREIGN PATENT DOCUMENTS 3215355 12/1982 Fed. Rep. of Germany .

*Primary Examiner*—John M. Jillions
*Attorney, Agent, or Firm*—Peter K. Kontler

[57] ABSTRACT

Apparatus for removing and advancing the leader of a cigarette paper web which forms a roll and whose leader adheres to the adjacent convolution has tongs one jaw of which is formed with a scraping edge movable against the periphery of the roll while the roll is rotated in a direction to pay out the web whereby the leader strikes against the edge and is separated from the adjacent convolution. The impact of the leader against the scraping edge releases a catch which normally holds the spring-biased other jaw of the tongs against movement toward engagement with the one jaw whereby the two jaws clamp the leader preparatory to transport directly to a splicing mechanism wherein the leader is attached to the trailing end of the preceding web or to a conveyor which transports the leader to the splicing mechanism.

20 Claims, 6 Drawing Figures

APPARATUS FOR LOCATING, ENGAGING AND TRANSPORTING THE LEADER OF CONVOLUTED CIGARETTE PAPER OR THE LIKE

CROSS-REFERENCE TO RELATED CASE

The apparatus of the present invention constitutes an improvement over and a further development of the apparatus which is disclosed in the commonly owned copending patent application Ser. No. 672,096 now U.S. Pat. No. 4,579,293 filed Nov. 15, 1984 by Wolfgang Steiniger for "Apparatus for withdrawing the leaders of webs of convoluted flexible material".

BACKGROUND OF THE INVENTION

The present invention relates to improvements in apparatus for locating or detecting, engaging and transporting the leaders of convoluted webs of paper or the like, e.g., cigarette paper, tipping paper or other strip-shaped materials which are used in the tobacco processing industry. More particularly, the invention relates to improvements in apparatus which can be used to separate the leaders from the adjoining convolutions of webs which form rolls or bobbins and wherein the leaders are bonded or otherwise secured to the adjoining convolutions, and to thereupon transport the separated leaders to a splicing mechanism wherein a freshly delivered leader is attached to the trailing end of the running web which forms part of an expiring roll so that the running web can entrain the leader into the wrapping mechanism of a cigarette maker, into the tipping unit of a filter tipping machine, into the wrapping mechanism of a filter rod making machine, to a selected station of a packing machine, or to any other station where a continuous web or strip of paper, foil or the like is used for the making of rod-shaped smokers' articles, for the packing of such articles, or for other purposes. Still more particularly, the invention relates to improvements in apparatus of the above outlined character wherein the leader of the web is engaged by tongs or by a similar tool for transport along a predetermined path as soon as the leader is separated from the adjoining portion of the convoluted web.

Commonly owned U.S. Pat. No. 4,245,795 to Ludszeweit et al. discloses an apparatus which is used to splice the leaders of fresh rolls of cigarette paper or the like to the trailing portions of expiring rolls and comprises means for transporting a freshly separated leader from the respective roll to the splicing mechanism. The apparatus employs a cutter which is moved in parallelism with the axis of a fresh roll to sever the outermost convolution and to thus establish or form a leader which is thereupon transported to the splicing station by suction.

A similar apparatus is disclosed in commonly owned German Offenlegungsschrift No. 32 15 355 which proposes to use a tongue-like implement as a means for penetrating between a pair of neighboring convolutions close to the periphery of a fresh roll and preparatory to severing of the thus separated outermost convolutions and subsequent clamping of the thus obtained leader for transport to the splicing station.

In accordance with a further prior proposal by the assignee of the present application, the severing tool cooperates directly with tongs which serve to engage the thus obtained leader for transport to the splicing mechanism.

Conventional apparatus exhibit the drawback that one or more outermost convolutions of the web must be severed in order to provide or form a leader which is ready to be transported to the splicing station upon removal of the severed convolution or convolutions. The severing operation is a discrete step which precedes clamping of the thus formed leader by tongs or by a similar mechanism preparatory to transport toward the splicing mechanism. Moreover, the severed convolution or convolutions constitute waste and must be gathered and disposed of at frequent intervals. Still further, the operation of the aforedescribed apparatus is unduly affected even by relatively minor deviations of the shape and/or position or orientation of a fresh roll from an optimum shape and/or position or orientation.

OBJECTS AND SUMMARY OF THE INVENTION

An object of the invention is to provide a novel and improved apparatus which can detect or locate, engage and transport the leader of a convoluted web of cigarette paper, tipping paper or other strip-shaped material regardless of eventual deviations of the shape and/or position or orientation of the convoluted web from an optimum shape and/or position or orientation.

Another object of the invention is to provide an apparatus which can locate, engage and transport the leader of a convoluted web without any waste in the material of the web and which need not employ any means for severing one or more convolutions of the web.

A further object of the invention is to provide an apparatus which takes up little room and whose operation can be more readily automated and automated to a greater extent than that of heretofore known apparatus.

Still another object of the invention is to provide the apparatus with novel and improved means for locating the leader of a convoluted web which forms a roll wherein the leader is bonded to the neighboring convolution.

A further object of the invention is to provide the apparatus with novel and improved means for clamping the leader of the convoluted web and with novel and improved means for transporting the clamping means.

Another object of the invention is to provide the apparatus with novel and improved means for automatically releasing the leader when the transport of such leader to the splicing station or to another destination is completed.

An additional object of the invention is to provide an apparatus which can be installed in existing web-processing machines or production lines as a superior substitute for heretofore known apparatus.

An additional object of the invention is to provide a novel and improved method of locating, engaging and transporting the leader of a convoluted web of cigarette paper or other strip-shaped material.

One feature of the invention resides in the provision of an apparatus for locating (i.e., detecting), engaging and transporting the leader of a convoluted web which forms a roll wherein the leader is bonded or otherwise separably secured to the adjoining convolution of the web. The web can consist of cigarette paper, tipping paper or other strip-shaped material which is utilized in the tobacco processing industry. The improved apparatus comprises means (e.g., a pivotable holder with a spindle) for supporting the roll (the spindle extends into the axial passage of the core around which the web is wound to form a roll), a d-c motor or other suitable means for rotating the roll on the supporting means in a direction to pay out the web, a locating device which is provided with a scraping edge and is movable to and from an operative position in which the scraping edge bears against the periphery of the roll on the supporting means and receives an impact from the oncoming leader with attendant separation of the leader from the adjoining convolution of the roll, a clamping device having means for pressing the leader of the web against the locating device in response to the impact of the leader against the scraping edge so that the separated leader is clamped between the two devices, and means for transporting the devices and the clamped leader along a predetermined path.

The apparatus preferably comprises tongs mounted on the transporting means and having a first jaw which constitutes or comprises the locating device and a second jaw which constitutes or comprises the clamping device. Still further, the apparatus comprises a splicing mechanism which can receive the leader directly from the clamping and locating devices or from a conveyor which has means for advancing the leader to the splicing mechanism. In such apparatus, the transporting means includes a member (e.g., a lever) which is movable between a first station at which the locating device assumes its operative position and a second station at which the advancing means of the conveyor receives the leader from the locating and clamping devices. Such apparatus then further comprises means for moving the transporting means between the first and second stations. The moving means can comprise a swivel arm which carries the transporting means, a fixed pivot for the swivel arm, and a motor, a transmission or other suitable means for moving the swivel arm back and forth about the axis of the pivot. The transporting means is preferably pivotable with reference to the swivel arm about a predetermined axis between two end positions, and such apparatus preferably further comprises means (e.g., a prestressed coil spring) for yieldably biasing the transporting means to one of its end positions. The scraping edge of the locating device is in engagement with the periphery of the roll on the supporting means in the one end position of the transporting means while such transporting means is located at the first station.

The pressing means can comprise a small roll or another rotary element, and the tongs preferably further comprise one or more torsion springs or other suitable resilient means for urging the clamping device toward a position of engagement of the pressing means with the locating device and/or for urging the locating device toward a position of engagement with the pressing means of the clamping device. Such tongs preferably further comprise blocking means (e.g., a detent or catch having a male portion or section on one of the two devices and a complementary female portion or section on the other device) for normally holding the locating device and the pressing means apart. The blocking means is disengageable in response to the impact of the leader of a convoluted web against the scraping edge of the locating device so as to enable the resilient means to propel the pressing means into clamping engagement with the separated leader, i.e., to press the freshly separated leader against the locating device.

The apparatus preferably further comprises means for automatically opening the tongs. For example, the clamping device can comprise a lever which is pivotably mounted on the transporting means and has a first arm carrying the scraping edge as well as a second arm which can strike against a roller or a like part of the opening means and serving to pivot the lever in response to movement of such lever from the first to the second station. This can entail automatic reengagement of the blocking means so that the pressing means releases the leader and the two devices are ready to engage the leader of a fresh web in response to return movement of the tongs to the first station.

The transporting means is preferably pivotable to one of its end positions in response to arrival at the second station. The means for pivoting the transporting means can comprise a rotary member which is mounted adjacent to the path of movement of the transporting means, and the latter is then provided with a follower which engages the rotary member during movement of the transporting means to the second station. The rotary member can be replaced with a stationary cam and the follower on the transporting means then preferably includes a roller which strikes against the cam and ensures that the transporting means is moved to the one end position.

The locating device can be provided with one or more suction ports which attract the leader of a web, at least in certain positions of the locating device and of the transporting means therefor.

Another feature of the invention resides in the provision of a method of detecting or locating, engaging and transporting the leader of a convoluted web which forms a bobbin or roll wherein the leader is bonded or otherwise separably secured to the adjoining convolution of the web. The method comprises the steps of rotating the roll in a direction to pay out the web, placing against the periphery of the roll a scraping edge which is provided on one jaw of a tongs so that the leader strikes against the scraping edge and is thereby separated from the adjoining convolution of the web, moving the other jaw of the tongs against the leader in automatic response to the impact of the leader against the scraping edge so that the freshly separated leader is clamped between the two jaws, and transporting the tongs and the clamped leader along a predetermined path. The transporting step can include pivoting the tongs about a predetermined axis.

The method can further comprise the steps of opening the tongs in a predetermined portion of the path and splicing the leader to the trailing end of a running web. The splicing step can be preceded by a step of conveying the leader, which has been released by the jaws of the tongs in the predetermined portion of the path, along a second path (e.g., along a straight path) which leads to the splicing station.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
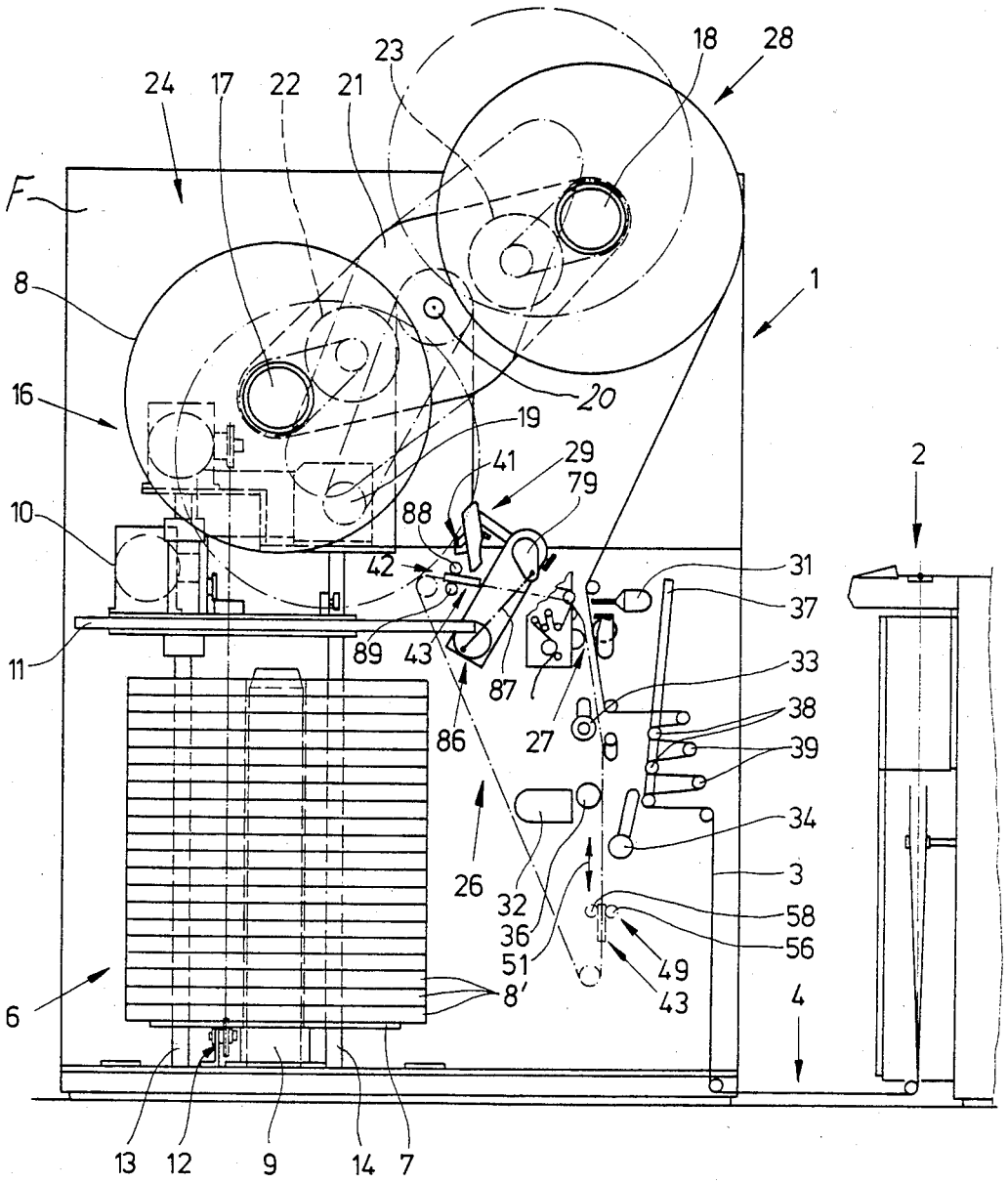
FIG. 1 is a schematic front elevational view of an apparatus which embodies one form of the invention and serves to transport the leaders of successive webs of cigarette paper or the like to the web splicing mechanism of a cigarette rod making machine.

FIG. 1 shows an apparatus 1 which is used in a production line for filter cigarettes or in a plain cigarette maker 2 to supply the leaders 72 of successive fresh webs or strips 108 to a splicing mechanism 27. A running web 3 which is drawn off an expiring bobbin or roll 28 advances through the splicing mechanism 27 along a predetermined path 4 and into the wrapping station of the cigarette maker 2. The latter is or can be of the type known as PROTOS (manufactured and sold by the assignee of the present application).

The apparatus 1 comprises a magazine 6 which can store a substantial supply of fresh bobbins or rolls 8'. The lowermost roll 8' rests on a horizontal platform 7 and the axial passages of the stacked rolls 8' receive an upright centering mandrel 9 which extends upwardly and beyond the upper side of the platform 7. The rolls 8' which are stacked in the magazine 6 are located in horizontal planes. Successive topmost rolls 8' of the stack on the platform 7 are engaged at required intervals by a transfer unit including annular tongs 11 pivotable by a motor 10 so as to change the orientation of the topmost roll 8' of the stack during transfer from the magazine 6 onto the spindle 17 or 18 of a holder 21 which is pivotable in the frame F of the apparatus 1. Each change of orientation involves the placing of the roll 8' which is grasped by the tongs 11 into a vertical plane so that the axial passage of the core of such roll can receive the spindle 17 or 18. The claws of the tongs 11 engage the periphery of the topmost roll 8' in the magazine 6, and the movements of such claws in the course of a transferring operation are selected with a view to ensure predictable transfer of the topmost roll 8' onto the supporting means including the pivotable holder 21 and the spindle 17 or 18.

Since the level of the topmost roll 8' in the magazine 6 varies in response to depletion or replenishing of the supply of stacked rolls 8', the tongs 11 are movable up and down by an elevator mechanism 16 including a driven endless chain 12 and two upright guides 13, 14 along which the base of the transfer unit including the tongs 11 can move up or down, e.g., in automatic response to signals from a detector which monitors the level of the topmost roll 8' in the magazine 6.

The axes of the spindles 17, 18 are horizontal, and the holder 21 is pivotable about the axis of a horizontal shaft 20 which is installed in the frame F midway between the spindles 17 and 18. The means for rocking the holder 21 back and forth about the axis of the shaft 20 comprises a reversible motor 19 in the frame F. D-c motors 22 and 23 are provided to respectively rotate the spindles 17 and 18 about their horizontal axes. The motors 22 and 23 are mounted on the holder 21 and each thereof is designed to rotate the roll on the respective spindle at least in a direction to pay out the convoluted web.

The fresh roll 8 which is supported by the spindle 17 contains a length of a convoluted web or strip 108 (see FIG. 2) whose leader 72 is bonded or otherwise separably secured (preferably by an adhesive) to the adjoining convolution 108*a* of the web 108 at a location 71 in such a way that a small portion or flag of the leader 72 extends or projects outwardly. The roll 8 is located at a (first) station 24 and its web 108 is ready to be transported to the splicing mechanism 27 of the cigarette maker 2 as soon as the diameter of the expiring roll 28 is reduced to a predetermined minimum value. This triggers the operation of the improved apparatus 1 by starting the d-c motor 22 in a direction to pay out the web 108, i.e. to rotate the spindle 17 in a counterclockwise direction (arrcw 96 in FIG. 2). The apparatus 1 comprises a composite web moving unit 26 having a transporting means including a lever 73, and a conveyor 43. The lever 73 of the transporting means transports a tongs 41 from the first station 24 to a second station 42 where the leader 72 of the web 108 is taken over by an advancing means 47, 48 of the conveyor 43, and the conveyor 43 thereupon completes the transport of the leader 72 into the splicing mechanism 27. The tongs 41 form part of a unit 29 which is designed to terminate the bond between the leader 72 and the adjoining convolution 108*a* of the web 108 which forms the roll 8 at the station 24.

The splicing mechanism 27 comprises a suction cup or nozzle 31 which serves to attract the running web 3 immediately behind the locus where such web is severed subsequent to or simultaneously with its splicing to the leader 72 of the fresh web 108, and a second suction cup or nozzle 32 which serves to attract the foremost part of the leader 72 ahead of the location where such leader is attached to the trailing end of the web 3. The splicing mechanism 27 further comprises two guide rolls 33, 34 and an accelerating roll 36 which serves to accelerate the leader 72 of the web 108 to the speed of the running web 3 prior to start of the splicing operation. A so-called dancer arm 37 resembles a lever which carries a set of idler rollers 38 cooperating with fixedly mounted idler rollers 39 to tension the running web 3 (and thereupon the fresh web 108) on its way into the wrapping mechanism of the cigarette maker 2. The arm 37 forms part of a tension monitoring device which transmits signals to the d-c motor 23, i.e., to the motor which drives the running web (3 in FIG. 1) so that the motor 23 can accelerate or brake the running web in order to ensure that such web will be maintained under an optimal tensional stress. The idler rollers 38 and 39 establish and maintain a supply of meandering wrapping material between the splicing mechanism 27 and the cigarette maker 2. A splicing mechanism which can be used in or with the cigarette maker 2 is disclosed, for example, in commonly owned U.S. Pat. No. 4,131,501 to Böttcher et al.

The units 26 and 29 are shown in greater detail in FIGS. 2–4 and 5*a*–5*b*. The tongs 41 of the unit 29 could be designed to transport the leader 72 of the fresh web 108 from the first station 24 all the way into the splicing mechanism 27. However, it is presently preferred to employ a composite web moving unit 26, namely a unit which includes the tongs 41 and a chain conveyor 43 which advances the leader 72 from the second station 42 all the way into the splicing mechanism 27 and, to this end, is provided with the aforementioned advancing means 47, 48 serving to accept the leader 72 from the tongs 41 and to deliver the leader to the splicing station. The lever 73 of the transporting means serves to pivot back and forth and to thereby transport the tongs 41 between the stations 24 and 42. The conveyor 43 further comprises an endless chain 44 which carries a shaft 50 for a pivotable portion 47 of the advancing means 47, 48. The portion 47 is a substantially L-shaped member which is biased by a torsion spring 46 in a direction toward the preferably spherical surface of the second portion 48. The spherical surface is coated with a friction generating liner and the leader 72 can be clamped between the pallet of the portion 47 and the friction generating liner (see FIG. 3) to reliably hold the leader during transport With the chain 44 toward the splicing station. As can be seen in FIG. 1, the advancing means 47, 48 can transport the leader 72 to a third station 49 which is located downstream of the splicing station and downstream of the suction nozzle 32. While the chain 44 can be mounted for unidirectional movement along an endless path, it is presently preferred to provide the conveyor 43 with a drive which moves the chain 44 back and forth (see the arrow 51 in FIG. 1) so that the advancing means 47, 48 reciprocates between the second station 42 and the additional station 49.

The means for opening the advancing means 47, 48 (i.e., for pivoting the portion 47 of such advancing means against the opposition of the torsion spring 46) at the station 42 comprises a guide roll 52 which ensures that the conveyor 43 maintains the portions 47, 48 in predetermined positions as soon as they reach the station 42, a roller-shaped opening member 54 which is rotatably mounted in the frame F, and a follower 53 which is provided on the portion 47 and strikes against the opening member 54 during the last stage of return movement of advancing means 47, 48 to the station 42. This entails a pivoting of the portion 47 to the position of FIG. 2 in which the portions 47, 48 provide ample room for the passage of the tongs 41 (which clamp the leader 72) therebetween before the spring 46 is again free to pivot the portion 47 counterclockwise, as viewed in FIG. 2, and to thereby clamp the leader 72 between the pallet of the portion 47 and the antifriction liner of the portion 48.

The means for opening the advancing means 47, 48 at the third station 49 comprises a second guide roll 56 (corresponding to the guide roll 52), a second roller-shaped opening member 58 (corresponding to the member 54) serving to ensure that the leader 72 is released before the advancing means 47, 48 begins its movement back to the second station 42, and a second follower 57 provided on the portion 47 and cooperating with the second opening member 58.

The tongs 41 comprises a first jaw 59 which constitutes a locating or detecting device for the leader 72 of the fresh web 108 at the station 24, and a second jaw 61 which constitutes a clamping device for the leader 72. The device or jaw 59 is pivotable about the axis of a first shaft 60 on the lever 73, and the device or jaw 61 is pivotable about the axis of a second shaft 65 on the lever 73. The jaw 59 is biased in a clockwise direction, as viewed in FIGS. 2, 3 or 4, by a torsion spring 62 so that it assumes an operative position (FIG. 2) in which its sharp scraping edge 69 bears against the periphery of the roll 8 at the station 24 as long as the lever 73 is held in the end position of FIG. 2. A similar torsion spring 63 biases the jaw 61 in a clockwise direction to thereby engage a blocking means or catch including a female portion 64 on the jaw 59 and a male portion 66 on the jaw 61. The catch 64, 66 is engaged (operative) in FIG. 2 and is disengaged in FIG. 3 so that the torsion springs 62 and 63 are then free to pivot the jaws 59 and 61 relative to each other in directions to clamp the leader 72 between the jaw 59 and a rotary roller-shaped pressing element 68 of the jaw 61. The pressing element 68 then urges the leader 72 against a facet 67 of the jaw 59. The pressing element 68 is preferably provided with a liner or coating of friction generating material.

Figure 2:
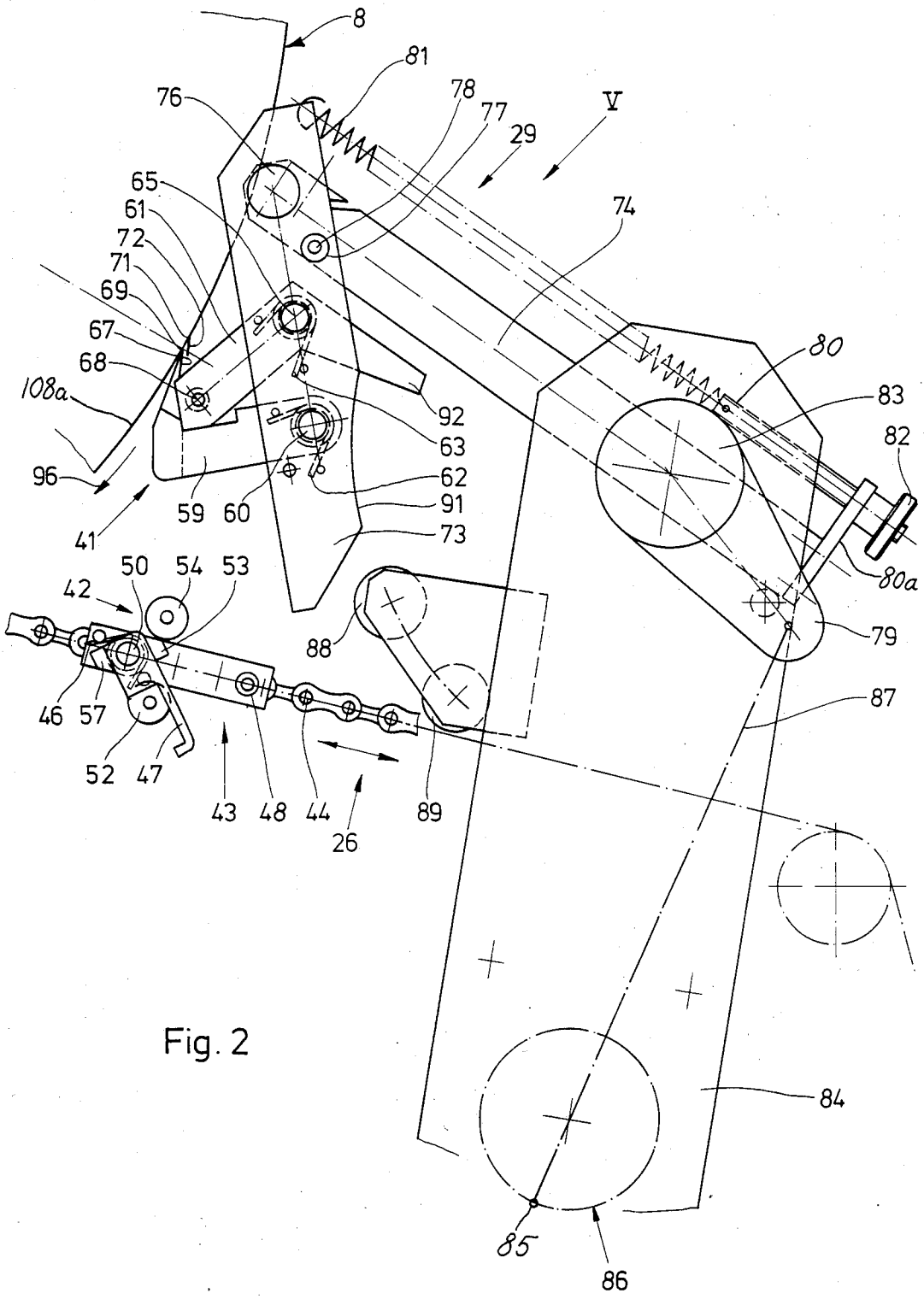
FIG. 2 is an enlarged view of a detail in the apparatus of FIG. 1, showing the combined locating, engaging and transporting unit in a first position preparatory to detection of the leader of a convoluted web.
Figure 3:
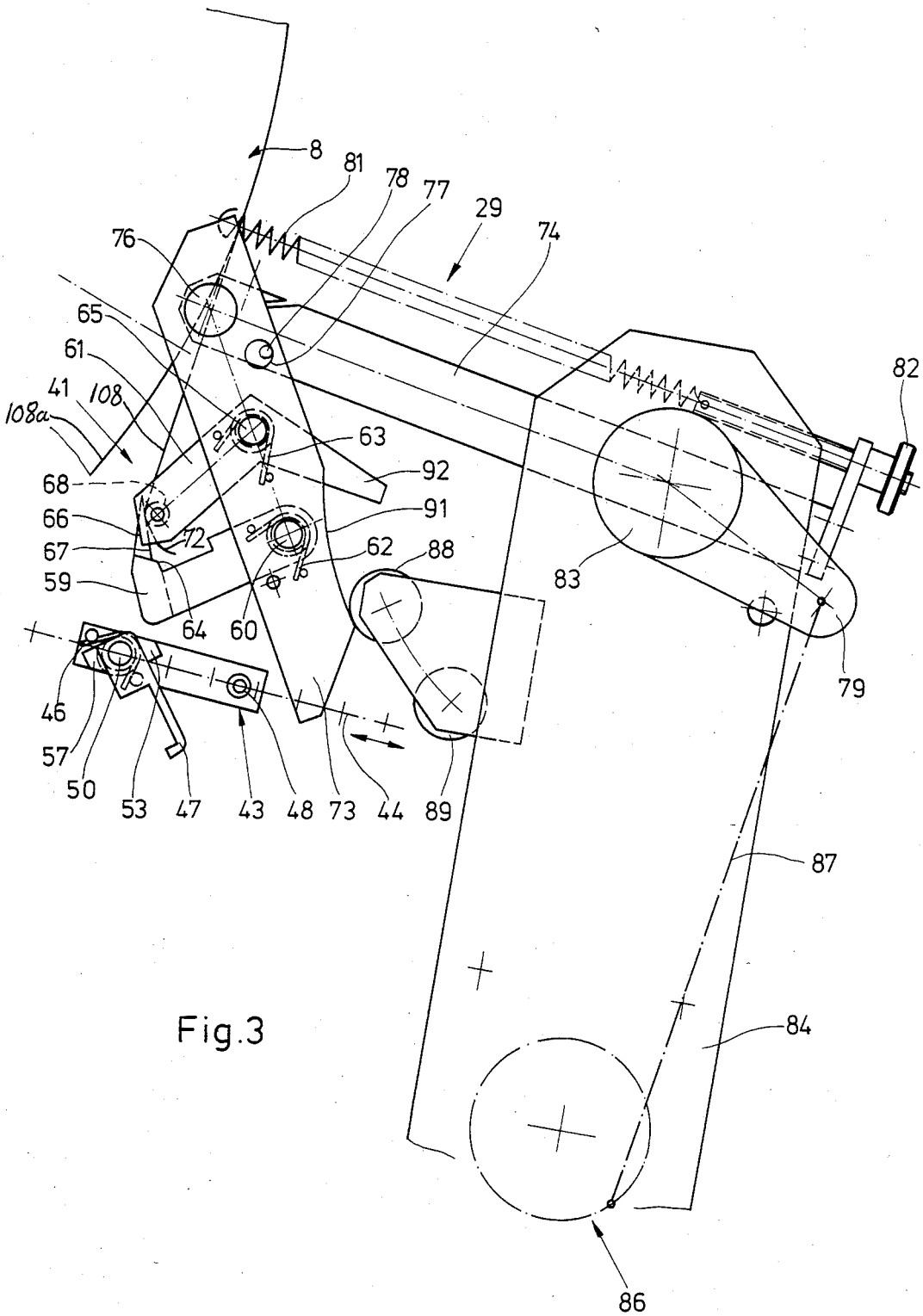
FIG. 3 illustrates the structure of FIG. 2 with the unit in a second position during transport of the leader toward a conveyor which, in turn transports the leader to the splicing mechanism.

When the elongated scraping edge 69 of the jaw 59 is caused to bear against the periphery of the fresh roll 8 at the station 24 under the action of a prestressed coil spring 81 which biases the lever 73 in a clockwise direction, as viewed in FIG. 2, such edge is located in the path of movement of the location 71 where the leader 72 of the web 108 is bonded to the adjoining convolution **108*a* provided, of course, that the d-c motor 22 is on and rotates the spindle 17 in a direction to pay out the web 108. Thus, the scraping edge 69 can locate or detect the leader 72 of the roll 8, and the impact of the orbiting leader 72 suffices to ensure that the edge 69 separates such leader from the adjoining convolution 108. In addition, such impact suffices to pivot the jaw 59 slightly against the opposition of the torsion spring 62 (which tends to pivot the jaw 59 in a clockwise direction, as viewed in FIG. 2). so that the blocking means or catch 64, 66 is disengaged and allows the torsion springs 62, 63 to pivot the respective jaws 59, 61 clockwise with the result that the freshly separated leader 72 is clamped between the facet 67 of the jaw 59 and the rotary pressing element 68 of the jaw 61**.

The transporting lever 73 for the tongs 41 is pivotable about the horizontal axis of a shaft 76 which constitutes a fulcrum for the lever 73 and is mounted at one end of an elongated swivel arm 74 forming part of the means for moving the lever 73 between two end positions to thereby move the tongs 41 between the stations 24 and 42. The apparatus 1 further comprises means for limiting the extent of pivotal movement of the lever 73 relative to the swivel arm 74, and such limiting means comprises a stud or post 78 provided on the swivel arm 74 and extending into a recess 77 of the lever 73. The prestressed coil spring 81 biases the lever 73 in a clockwise direction, as viewed in FIG. 2, so as to maintain such lever in one of the two end positions with reference to the swivel arm 74. The bias of the coil spring 81 is adjustable by a nut 82 meshing with an externally threaded stud 80 which extends through a bracket **80*a* on the frame F and is attached to one end convolution of the spring 81. A fixed pivot 83 for the swivel arm 74 is mounted on a stationary carrier 84, and the swivel arm 74 is pivotable back and forth about the axis of the pivot 83 by a crank drive including an eccentric 85 on a driven disc 86 and a connecting rod 87 which couples the eccentric 85 with a lug or extension 79 of the swivel arm 74**.

The carrier 84 further supports a pair of rotary members 88 and 89 which are rotatable about horizontal axes and are adjacent to the path of movement of the transporting lever 73 between the stations 24 and 42. The rotary member 88 cooperates with a follower 91 of the lever 73 to pivot the latter to its right-hand end position against the opposition of the coil spring 81 during the last stage of movement of the lever 73 to the station 42. This ensures that the tongs 41 is in an optimum position to pass between the portions 47, 48 of the advancing means on the chain 44 of the conveyor 43.

The rotary member 89 constitutes a means for opening the tongs 41 at the station 42 as soon as the leader 72 has been caused to pass between the portions 47, 48 of the advancing means on the conveyor 43. The rotary member 89 cooperates with -an arm 92 of the jaw 61 to pivot the latter about the axis of the shaft 65 against the opposition of the torsion spring 63 and to thereby reengage the portions or sections 64, 66 of the catch for the jaws 59, 61.

Figures 5A, 5B:
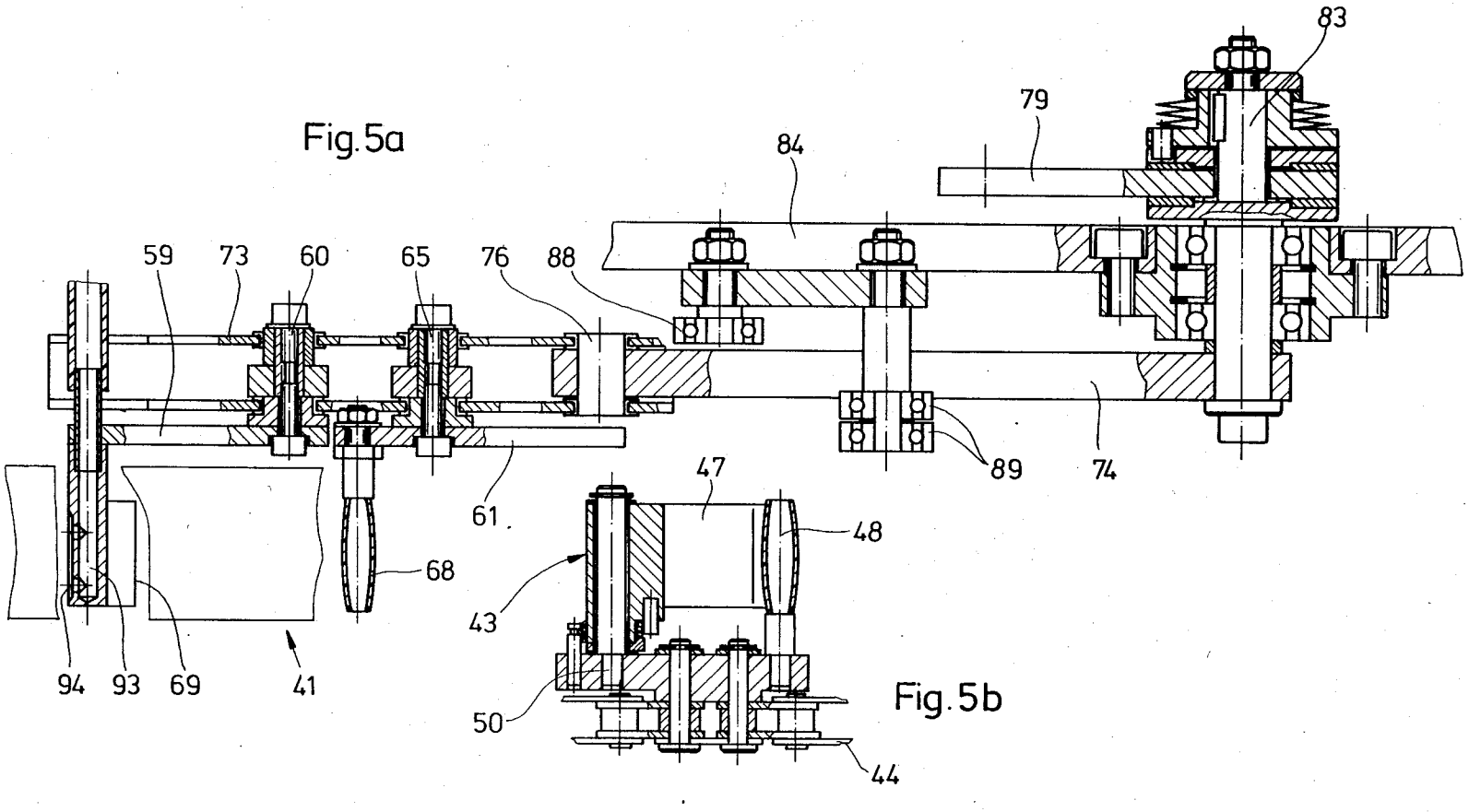
FIG. 5*a* is an enlarged partly sectional view of a detail as seen in the direction of arrow V in FIG. 1.
FIG. 5*b* is an enlarged fragmentary sectional view of the conveyor.

FIG. 5*a* shows that the jaw 59 is formed with a channel 93 (FIG. 5*a*) which communicates with several suction ports 94 serving to attract the leader 72. The manner in which the channel 93 is connectable to a suction generating device (which is available in every cigarette maker) is not specifically shown in the drawing. The open ends of the ports 94 are provided in that surface of the jaw 59 which is located opposite the facet 67, i.e., which faces the periphery of the roll 8 at the station 24.

The mode of operation of the apparatus 1 is as follows:

FIG. 1 shows that the expiring roll 28 pays out the running web 3 which advances through the splicing mechanism 27 and along the path 4 into the wrapping mechanism of the cigarette maker 2. The fresh roll 8 is mounted on the spindle 17 of the holder 21, and the leader 72 of its web 108 is bonded to the adjoining convolution 108*a* at the location 71 (FIG. 2). The tongs 11 is in a position of readiness to deliver the topmost roll 8' from the magazine 6 onto the spindle 18 as soon as the roll 28 is exhausted and its core is removed from the spindle 18 preparatory to pivoting of the holder 21 through 180 degrees so that the spindles 17, 18 change positions and the web 108 advances along the path for the web 3 of FIG. 1.

In order to initiate a splicing operation, the supply of web 3 on the roll 28 must be exhausted to a predetermined extent so that a suitable detector (not shown) which monitors the diameter of the roll 28 transmits a signal to the motor 19 for the holder 21 whereby the latter is pivoted in a counterclockwise direction from the solid-line to the phantom-line position of FIG. 1. At such time, the transporting lever 73 maintains the tongs 41 at the station 24 so that the peripheral surface of the oncoming roll 8 comes into contact with the scraping edge 69 of the locating device or jaw 59 of the tongs 41.

In the next step, the motor 22 is started to rotate the spindle 17 (and hence the fresh roll 8) in a direction (arrow 96 in FIG. 2) to pay out the web 108, e.g., at 15 revolutions per minute. This causes the location 71 of attachment of the leader 72 to the convolution 108*a* of the web 108 to impact against the scraping edge 69 whereby the edge 69 separates the leader 72 from the convolution 108*a* and directs the leader 72 into the space between the facet 67 of the jaw 59 and the pressing element 68 on the clamping device or jaw 61 of the tongs 41. As already explained above, the impact of the location 71 against the scraping edge 69 suffices to pivot the jaw 59 against the opposition of the torsion spring 62 so that the catch 64, 66 is disengaged and allows the torsion springs 62, 63 to move the facet 67 and the pressing element 68 toward each other, i.e., the leader 72 is clamped between the jaws 59, 61 as soon as it becomes separated from the adjoining convolution 108*a* of the web 108 which forms the fresh roll 8.

The motor 22 is arrested after the roll 8 completes a certain number of revolutions in the direction of arrow 96, and the motor 19 is thereupon started to return the holder 21 from the phantom-line to the solid-line position of FIG. 1 i.e., the holder 21 is pivoted in a clockwise direction. At the same time (see FIG. 3), the disc 86 of the drive means for the swivel arm 74 is set in rotary motion so as to turn the arm 74 about the pivot 83 in a counterclockwise direction whereby the follower 91 of the lever 73 strikes against and slides along the rotary member 88 on the carrier 84. This ensures that the lever 73 is held in one of its end positions relative to the swivel arm 74, this end position being determined by the stud 78 of the swivel arm 74 and the surface bounding the recess 77 in the lever 73. At such time, the tongs 41 is in an optimum position to advance between the portions 47, 48 of the advancing means on the conveyor 43 (the pallet of the portion 47 is then remote from the portion 48).

Figure 4:
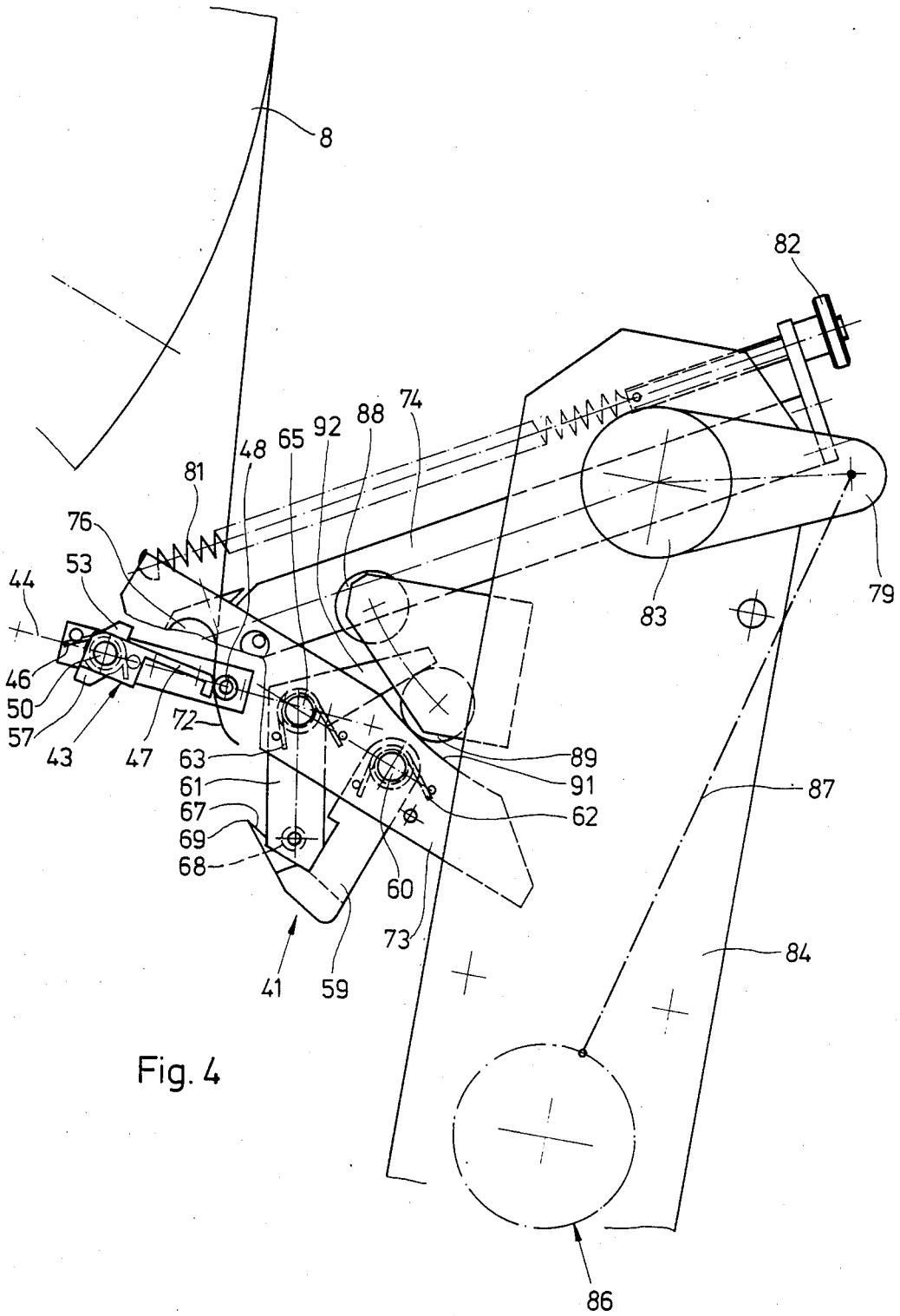
FIG. 4 illustrates the structure of FIGS. 2 and 3 in a third position subsequent to transfer of the leader onto the conveyor.

Before the tongs 41 reaches the end position of FIG. 4, the motor which reciprocates the chain 44 is set in motion so that the follower 53 of the portion 47 of the advancing means 47, 48 is disengaged from the opening member 54 and the advancing means 47, 48 closes under the action of the torsion spring 46 to clamp the leader 72. At such time, the arm 92 of the jaw 61 (which is actually a two-armed lever) strikes against the rotary member 89 on the carrier 84 so that the tongs 41 open because the pressing element 68 is moved away from the facet 67 of the jaw 59. Thus, the leader 72 is released by the jaws 59, 61 but is clamped between the portions 47, 48 of advancing means on the conveyor 43 for transport to the station 49. The rotary member 89 further causes the sections or portions 64, 66 of the catch to reengage each other so that the tongs 41 is again cocked for engagement of the leader of the next fresh roll which is transferred from the magazine 6 onto the spindle 18 of the holder 21.

The chain 44 is thereupon caused to move the advancing means 47, 48 and the leader 72 therebetween to the station 49 where the follower 57 of the portion 47 strikes against the roller-shaped opening member 58 so that the advancing means 47, 48 releases the leader 72 which is then in an optimum position for splicing to the running web 3 as soon as the roll 36 has been set in rotary motion to accelerate the web 108 to the speed of the web 3. The guide rolls 33 and 34 engage the leader 72 (actually the web 108 behind its leader 72) not later than when the follower 57 engages the opening member 58 at the station 49, i.e., the leader 72 is held by the rolls 33, 34 not later than when such leader is released by the advancing means 47, 48.

The accelerating roll 36 is set in motion when the diameter of the expiring roll 28 is reduced to a predetermined value, and the web 108 is thereby accelerated to the speed of the web 3 preparatory to splicing of the webs 3 and 108 to each other. The splicing mechanism 27 comprises means for severing the web 3 behind the splice and for severing the web 108 in front of the splice. The remnant of the web 3 is then attracted by the suction nozzle 31 and the severed portion of the leader 72 of the web 108 is attracted by the suction nozzle 32.

The manner in which the holder 21 is pivoted back and forth to transport the spindle 17 or 18 to the station 24 is well known and need not be described here. It suffices to say that the holder 21 is pivoted to move the spindle 17 to the station occupied in FIG. 1 by the spindle 18 in good time before the supply of web 108 expires so that a fresh roll (8') can be transferred from the magazine 6 onto the spindle 18 and such fresh roll is thereupon manipulated in a manner as described above for the roll 8.

The parts 73, 74 are returned to the positions of FIG. 2 not later than when the leader of the next fresh roll is to be separated from the adjoining convolution of the roll on the spindle 18.

If the web 108 tears during transport from the station 42 to the station 49, or if the splice between the webs 3 and 108 is unsatisfactory and breaks before the web 108 is introduced into the wrapping mechanism of the cigarette maker 2, the direction of rotation of the motor 22 is reversed so that the web 108 is wound back onto the spindle 17. The suction ports 94 then communicate with the suction generating device via channel 93 of the jaw 59, i.e., the leader 72 is attracted to the jaw 59 and is transported to the advancing means 47, 48 of the conveyor 43 for renewed transport to the splicing station.

The mounting of the tongs 41 on the pivotable lever 73 which, in turn, is pivotably mounted on the swivel arm 74, contributes to compactness and simplicity of the improved apparatus. Pivotability of the lever 73 relative to the swivel arm 74 ensures that the scraping edge 69 can bear against the periphery of the roll 8 even if the roll 8 is out of round and/or wobbles during rotation about the axis of the spindle 17 and/or if the diameter of the roll 8 deviates from the anticipated or standard diameter. The means for biasing the scraping edge 69 against the periphery of the roll 8 (through the medium of the lever 73) is the coil spring 81 whose bias is adjustable by the nut 82. The rotary member 88 ensures that the tongs 41 is invariably held in an optimum position for introduction of the leader 72 into the gap between the spaced-apart portions 47, 48 of advancing means on the conveyor 43 when the tongs 41 reaches the station 42.

The improved apparatus exhibits the advantage that the means for locating, engaging and transporting the leader of a fresh web need not employ any severing means because the scraping edge 69 of the jaw 59 automatically separates the leader 72 from the neighboring convolution 108*a* of the web 108 as soon as the location 71 where the leader is bonded to the convolution 108*a* strikes against the edge 69. This simplifies the construction of the apparatus and ensures that the material of the web 108 is not wasted preparatory to and during transport to the splicing station. The leader 72 is bonded or otherwise separably secured to the adjacent convolution 108*a* anyway, and the invention takes advantage of the existence of such bond to ensure waste-free and reliable threading of the leader of the fresh web through the apparatus and on to the splicing mechanism.

Another important advantage of the improved apparatus is that the leader can be readily separated from the neighboring convolution of a fresh web, even if the diameter and/or shape and/or position of the fresh roll deviates from the desired or optimum diameter or shape or position. Eventual wobbling of the fresh roll on the spindle 17 or 18 also fails to affect the reliability with which the improved apparatus locates, engages and transports the leader of the fresh web into the splicing station. Higher reliability of the improved apparatus contributes significantly to the reliability of the entire cigarette maker 2 and also of the entire production line if the maker 2 constitutes one of a series of machines which include one or more cigarette makers, one or more filter rod making machines, one or more filter tipping machines and one or more cigarette packing machines.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for locating, engaging and transporting the leader of a convoluted web which forms a roll wherein the leader is separably secured to the adjoining convolution of the web, comprising means for supporting the roll; means for rotating the roll on said supporting means in a direction to pay out the web; a locating device having an edge and being movable to and from an operative position in which said edge bears against the periphery of the rotating roll and receives an impact from the oncoming leader with attendant separation of the leader from the adjoining convolution of the roll; a clamping device having means for pressing the leader of the web against said locating device in response to said impact so that the leader is clamped between said devices; and means for transporting said devices and the clamped leader along a predetermined path.

2. The apparatus of claim 1, further comprising tongs mounted on said transporting means and having a first jaw comprising said locating device and a second jaw comprising said clamping device.

3. The apparatus of claim 2, further comprising a splicing mechanism and a conveyor having means for advancing the leader of the web to said splicing mechanism, said transporting means including a member movable between a first station at which said locating device assumes said operative position and a second station at which said advancing means receives the leader from said devices.

4. The apparatus of claim 3, further comprising means for moving said member of said transporting means between said first and second stations.

5. The apparatus of claim 4, wherein the means for moving said member comprises a swivel arm, a pivot for said swivel arm and means for moving said swivel arm back and forth about the axis of said pivot.

6. The apparatus of claim 4, wherein said member of said transporting means is pivotable with reference to said moving means about a predetermined axis between two end positions and further comprising means for yieldably biasing said member to one of said end positions, the edge of said locating device being in engagement with the periphery of the roll on said supporting means in said one end position of said member while said member is located at said first station.

7. The apparatus of claim 2, wherein said pressing means comprises a rotary element.

8. The apparatus of claim 2, further comprising resilient means for urging said clamping device toward a position of engagement of said pressing means with said locating device.

9. The apparatus of claim 2, further comprising resilient means for urging said locating device toward a position of engagement with said pressing means.

10. The apparatus of claim 2, further comprising resilient means for urging at least one of said devices toward a position of engagement of said pressing means with said locating device and blocking means for normally holding said locating device and said pressing means apart, said blocking means being disengageable in response to the impact of the leader against said edge so as to enable said resilient means to bring said pressing means into clamping engagement with the separated leader.

11. The apparatus of claim 10, wherein said blocking means comprises a catch having a first section on said locating device and a complementary second section on said clamping device.

12. The apparatus of claim 2, further comprising means for opening said tongs.

13. The apparatus of claim 12, wherein said clamping device comprises a lever which is pivotably mounted on said transporting means and has a first arm carrying said pressing means and a second arm, said opening means including means for pivoting said second arm.

14. The apparatus of claim 2, further comprising a splicing mechanism, a conveyor having means for advancing the leader of the web to said splicing mechanism, means for moving said transporting means between a first station at which said locating device assumes said operative position and a second station at which said advancing means receives the leader from said devices, means for movably mounting said transporting means on said moving means so that the transporting means is pivotable between first and second end positions, and means for pivoting said transporting means to one of said end positions in response to arrival of said transporting means at said second station.

15. The apparatus of claim 14, wherein said pivoting means comprises a rotary member and said transporting means includes a lever having a follower which engages said rotary member during movement of said lever to said second station.

16. The apparatus of claim 1, wherein said locating device has at least one suction port which attracts the leader of the web.

17. A method of detecting, engaging and transporting the leader of a convoluted web which forms a roll wherein the leader is separably secured to the adjoining convolution of the web, comprising the steps of rotating the roll in a direction to pay out the web; placing against the periphery of the roll a scraping edge provided on one jaw of a tongs so that the leader impacts against the scraping edge and is thereby separated from the adjoining convolution of the web; moving the other jaw of the tongs against the leader in response to the impact of the leader against the scraping edge so that the leader is clamped between the two jaws; and transporting the tongs and the clamped leader along a predetermined path.

18. The method of claim 17, wherein said transporting step comprises pivoting the tongs about a predetermined axis.

19. The method of claim 17, further comprising the steps of opening the tongs in a predetermined portion of said path, and splicing the leader to the trailing end of a running web.

20. The method of claim 17, further comprising the steps of opening the tongs in a predetermined portion of said path, and conveying the thus released leader along a second path.

* * * * *